US005077845A

United States Patent [19]

Tokunaga et al.

[11] Patent Number: 5,077,845

[45] Date of Patent: Jan. 7, 1992

[54] BED WITH BUILT-IN COMMODE

[75] Inventors: Kenki Tokunaga, Isesaki; Shin-ichi Akahira; Takahide Kakinuma, both of Ohta; Takeshi Itagaki, Isesaki; Kyuichi Kawashima, Ouizumi, all of Japan

[73] Assignee: Sanyo Electric Co., Ltd., Osaka, Japan

[21] Appl. No.: 598,163

[22] Filed: Oct. 16, 1990

[30] Foreign Application Priority Data

Oct. 20, 1989 [JP] Japan ..... 1-273301
Dec. 18, 1989 [JP] Japan ..... 1-327649

[51] Int. Cl.[5] ..... A61G 7/02

[52] U.S. Cl. ..... 5/90; 5/446; 5/463; 4/237

[58] Field of Search ..... 5/90, 463, 446, 455, 5/453, 431; 4/443, 444, 446, 237, 251, 377, 348; 128/65, 60

[56] References Cited

U.S. PATENT DOCUMENTS

| | | | |
|---|---|---|---|
| 1,589,377 | 6/1926 | Dry | 5/90 |
| 2,427,953 | 9/1947 | Fishko | 4/444 |
| 3,650,138 | 9/1971 | Tucker | 5/90 |
| 3,729,749 | 5/1973 | Rosecrans | 5/90 |
| 3,757,355 | 9/1973 | Allen | 5/90 |
| 3,943,583 | 3/1976 | Ishikawa . | |
| 4,181,988 | 1/1980 | Skaggs | 4/237 |
| 4,287,618 | 9/1981 | Silver | 4/443 |
| 4,496,132 | 6/1985 | Weingarten | 251/61.1 |
| 4,754,508 | 7/1988 | Nishiguchi . | |
| 4,761,837 | 8/1988 | Takada | 4/443 |

FOREIGN PATENT DOCUMENTS

| | | | |
|---|---|---|---|
| 317854 | 2/1919 | Fed. Rep. of Germany | 4/18 |
| 58-81038 | 5/1983 | Japan . | |
| 59-79121 | 5/1984 | Japan . | |
| 62-194336 | 12/1987 | Japan . | |
| 1-74732 | 7/1989 | Japan | 4/443 |
| 2133055 | 7/1984 | United Kingdom | 4/443 |

*Primary Examiner*—Gary L. Smith
*Assistant Examiner*—F. Saether
*Attorney, Agent, or Firm*—Oblon, Spivak, McClelland, Maier & Neustadt

[57] ABSTRACT

A bed with a built-in commode is provided which has a bed frame, a mattress having a through-hole formed almost at the central portion of the mattress and placed on the bed frame, a commode attached to the mattress at the through-hole, a pair of inflatable outer tubular pads laid along the opposed edge parts of the commode, a pair of inflatable inner tubular pads laid between the pair of outer tubular pads, a water inlet port disposed in the commode, a discharge passage communicated with the commode, an inflatable valve disposed in the discharge passage, and a controlling device to control the valve and the turbular pads. The controlling device is housed in an operating panel to control both the valve and the tubular pads so that the valve and the pair of outer tubular pads are inflated while the pair of inner tubular pads are deflated when a patient excretes, while both the pair of outer tubular pads and the pair of inner tubular pads are deflated when the valve is inflated for hip bathing. By virtue of the structural features mentioned above, it is possible to carry out both excretion and hip bathing while a patient remains lying on the bed.

4 Claims, 17 Drawing Sheets

| CYCLE | FIRST CYCLE | | | | SECOND CYCLE | | | | THIRD ·· |
|---|---|---|---|---|---|---|---|---|---|
| SEQUENCE / RUBBER PADS | ① | ② | ③ | ④ | ① | ② | ③ | ④ | ① ···· |
| 7b | H | H | S | H | H | H | S | H | ····· |
| 7c | H | H | S | H | H | H | S | H | ····· |
| 7e | H | H | S | H | H | H | S | H | ····· |
| 7a | S | H | H | H | S | H | H | H | ····· |
| 7d | S | H | H | H | S | H | H | H | ····· |

NOTE : H = HARD
S = SOFT

BED WITH BUILT-IN COMMODE

BACKGROUND OF THE INVENTION

1. Field of the Invention

The Present invention relates to an improved bed with a built-in commode suitable for a user such as a partly paralyzed patient, bedridden person or the like.

2. Description of the Prior Art

Conventionally, this kind of bed includes the following types, namely, a bed provided with a through-hole which can be opened or closed by an air mattress, as disclosed in Japanese Patent Application Laid-Open No. 58-81038 in 1983, a bed provided with a commode which can be washed by water after the excretion, as disclosed in Japanese Utility Model Application Laid-Open No. 62-194336 in 1987, and a bed provided with an auxiliary mattress and a commode which are moved by a driving means, as disclosed in U.S. Pat. Nos. 3,943,538 and 4,754,508.

Further, with respect to a treament carried out after the excretion, there has been disclosed, as a prior art, a bed having a built-in commode washable with water and a hip bath as discloed in Japanese Utility Model Application Laid-Open No. 59-79121 in 1984.

SUMMARY OF THE INVENTION

The above prior art mentioned above, however, have following drawbacks (problems to be solved).

The bed disclosed in the above-mentioned Japanese Patent Application Laid-Open No. 58-81038 has a drawback, that is, when the air mattress is made to provide a cushioning effect to the portion being in contact with the user's hip or hips, the through-hole of the mattress cannot be sealed tight, and thus foul odors float outside after the excretion.

The beds disclosed in the U.S. Pat. Nos. 3,943,583 and No. 4,754,508, have such drawbacks that those beds necessitate a drive unit which is complex in construction and large in size to move the auxiliary mattress, and thus such beds become expensive in production cost.

The bed disclosed in Japanese Utility Model Application Laid-Open No. 62-194336 is fairly a sanitary one since the excrement is washed away with water, but it has such a drawback that if the commode is in dry state when used, the excrement is liable to adhere thereto, therefore, the excrement adhered to the commode is difficult to wash away, and it requires a large amount of water for washing.

The hip bath disclosed in Japanese Utility Model Application Laid-Open No. 59-79121 can be said to be effective to apply appropriate extent of stimulus to stimulate the excretive organs such as the anus and the like (hereinafter, referred to as the anal portion), thereby improve blood circulation, and thus keeps the anal portion clean since it washes the anal portion with hot water and bubbles.

The hip bath, however, has a drawback in that since the air in a room is upwardly blown into the hot washing water, the temperature of the hot bath is quickly lowered when the temperature of the room is low in winter and the like.

Therefore, a user of such bath may not be able to wash the anal portion in a comfortable manner.

A first object of the present invention is to provide a bed with a built-in commode conveniently used for bedridden persons who need a medical care for a long period of time.

A second object of the present invention is to provide a bed with a built-in commode having a massaging function for preventing bedsores or the like from occuring which inevitably arise from this kind of bed having a built-in commode.

A third object of the present invention is to provide a bed with a built-in commode having a shower and a hip bath means for preventing both the excrement from adhering to the commode and the foul odor arising therefrom, leaking and floating in the patients' room, and enabling this kind of patient to readily wash their anal portion after the excretion and keep them clean. Furthermore, the hip bath means permits a patient to warm his hips, which are likely to be cooled during excretion.

Other objects of the present invention will be apparent from several embodiments of this invention described below.

DETAILED DESCRIPTION OF THE INVENTION

Figure 1:
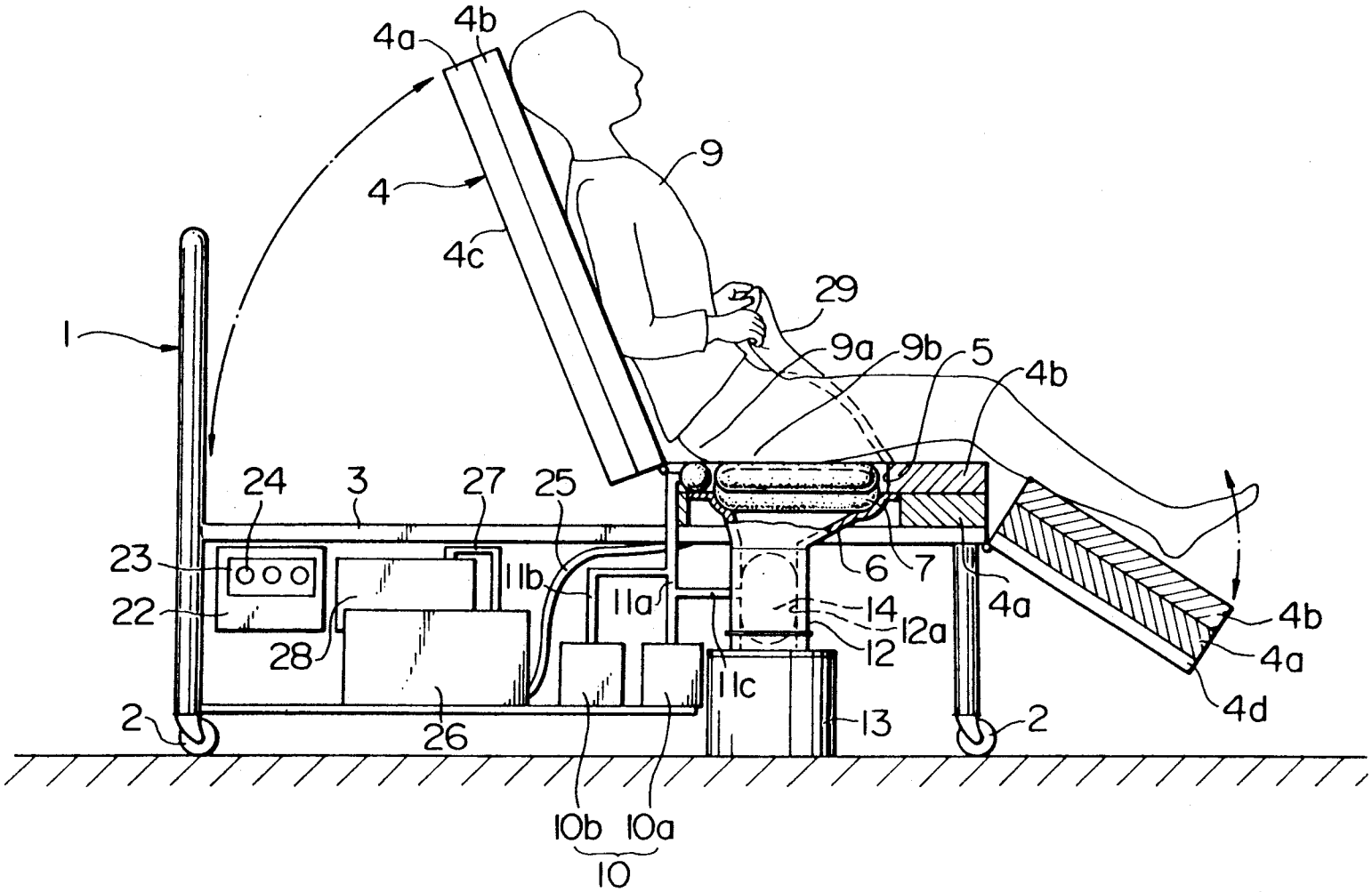
FIG. 1 is a front elevational view, partly in cross section of a bed with an overall built-in commode according to the present invention.

The present invention will be specifically explained hereunder with reference to the embodiments shown in the drawings.

FIG. 1 is a front elevational view partly in cross section of the main part of a bed with a built-in commode, wherein numeral 1 designates a bed main body comprising a mattress 4 placed on a bed frame 3 having a plurality of casters 2, the mattress 4 is shown being provided with a rectangular shaped through-hole 5 in cross section passing through the mattress substantially at the center thereof.

Note that the mattress 4 is of a two layer type and includes a general type mattress 4*a* cushioned with springs (not shown) or the like to be placed on the surface of the bed frame as an upper layer and a top layer 4*b* which directly contacts and supports the user lying on the bed and which can be, but need not necessarily be, an air inflatable mattress.

Both of these two layers of mattresses are separated into three sections along two transverse fold lines so that the upper half body of a user can be raised up during the excretion and/or urination.

Figure 2:
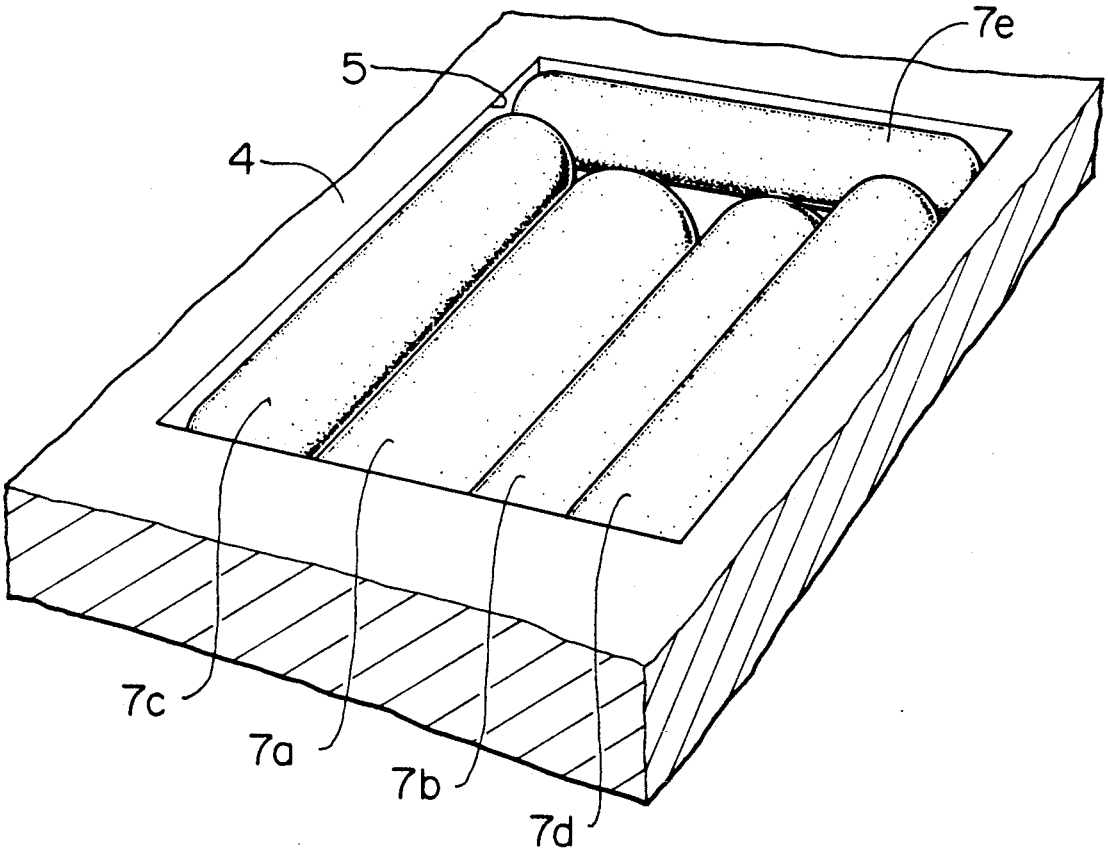
FIG. 2 and FIG. 9, respectively, is a perspective view of a commode and its vicinity.
Figure 3:
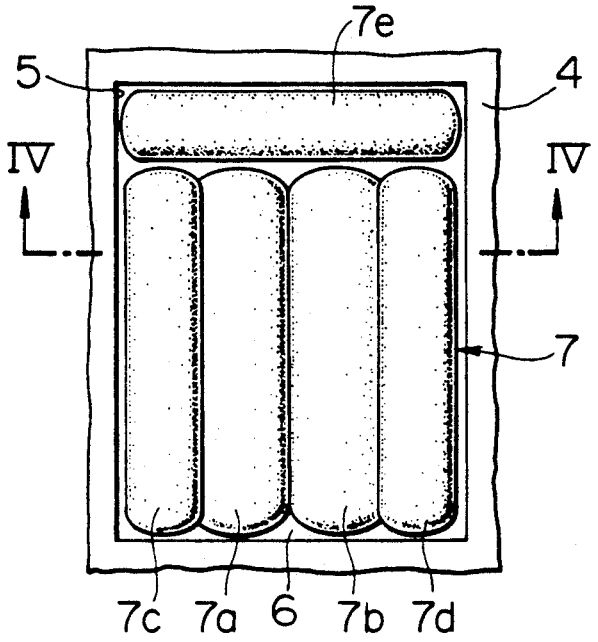
FIGS. 3, 5, 7, 12, 15 and 17, are plan views of the commode, each showing the commode and the vicinity thereof as a main part, respectively.

The bed frame 3 is provided with a commode 6 disposed in the through-hole 5 in communication therewith and a plurality of inflatable bar-shaped tubular rubber pads, hereafter referred to as rubber pad or pads or merely pad or pads, for example, a pair of inner tubular pads 7*a*, 7*b* and a pair of outer tubular pads 7*c*, 7*d* are disposed in the interior space defined by the circumferential wall of the commode 6 and on the rear marginal part of the commode 6 as shown in FIGS. 2 and 3.

In more detail, the rubber pads 7*a*–7*d* are fixed onto the side walls at both (right and left) sides of the commode 6 and the remaining rubber pad 7*e* is attached onto the rear end wall of the commode 6, in such a way that two rubber pads 7*c* and 7*a*, as a first pair are separately fixed onto the top flat portion and the inclined portion of the left side wall, respectively, and the pads 7*d* and 7*b* as the other pair are attached onto the right side wall of the commode 6 in a manner quite the same as explained above.

With respect to the arrangement of these pads, four pads 7*a*–7*d* in two pairs are fixed onto the right and left inside surfaces, respectively, of the commode 6 fabricated of a synthetic resinous material such as FRP (fiber reinforced plastics) such that these four pads each extending in lengthwise direction, are transversely arrayed just below the hips of the user, and each of the pads 7*a* and 7*b* in the inner array of each pair is made somewhat larger than in size and is positioned slightly lower than the pads 7*c* and 7*d* in the outer array, so that both the two pads 7*a* and 7*b* in the two pairs, when deflated, will move oppositely toward the opposite side walls of the commode 6.

The remaining pad 7*e* is fixed on the rear inside surface of the commode 6 to extend transversely to situate just below the waist, more correctly, the coccyx of the user.

As shown in FIGS. 5 through 8, rubber pads 7*c*, 7*d* and 7*e* out of five rubber pads 7*a* through 7*e* constitute a commode seat, while the rubber pads 7*a* and 7*b* act to open or close the opening 8 of the commode 6 when the patient 9 carries out excretion, and all of these rubber pads 7*a* through 7*e* act to support the user's hips excepting when the rubber pads 7*a* and 7*b* are acting to open or close the commode opening 8.

Note that the rubber pad 7*e* is a preferable one so as to support the hips 9*a* only in more comfortable manner, and it may be omitted.

Further, these rubber pads 7*a* to 7*e* are connected to the air compressor 10*a* and vacuum pump 10*b*, of an air supply and discharge device 10 disposed below the bed main body 1 via hoses 11*a* and 11*b*, respectively.

Numeral 12 designates a discharge pipe integrally formed with the commode 6 and connected to an excrement tank 13 placed on a floor.

Numeral 14 designates a valve consisting of a substantially spherical inflatable rubber ball for opening and closing the passage 12*a* of the discharge pipe 12 (hereafter referred to as a discharge passage), connected to the air supply and discharge device 10 through a hose 11*c*, and fixed to a recess 12*b*. Since the valve 14 is formed as a rubber ball to be received in the discharge passage 12*a* and particularly being seated in the recess 12*b*, when it is inflated to close the passage 12*a*, the valve can be closed at a fairly low fluid pressure, accordingly the patient's hand can be prevented from being injured even if his hand may be accidentally caught by the inflated rubber ball valve 14.

Figure 9:
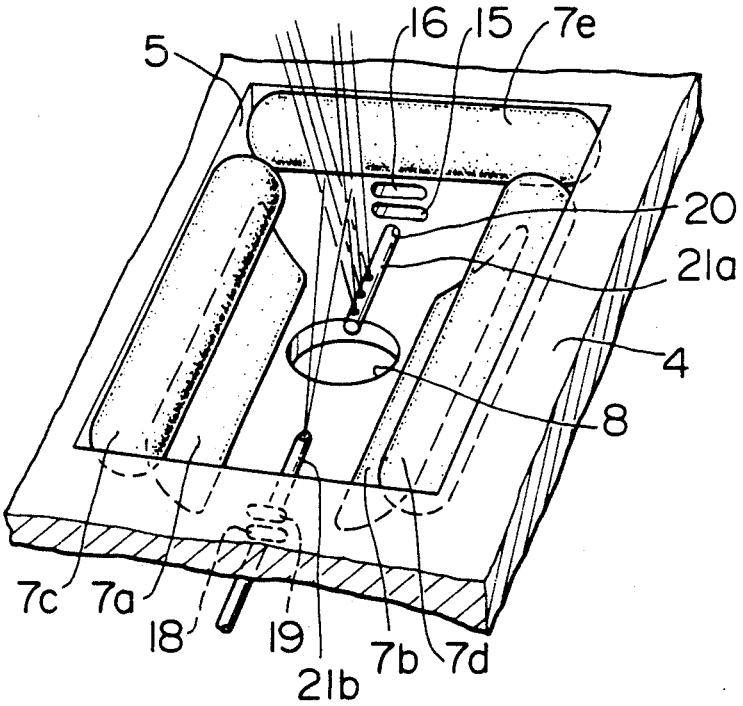

Numeral 15 designates a hot water supply port for spraying washing water used for bathing and washing the hips and anal portion 9*b* of the patient 9 and the commode 6, numeral 16 designates a port for dispensing detergent or soap solution, and numeral 17 designates an air outlet port for forming hot water bubbles, numeral 18 designates a hot air outlet port, numeral 19 designates a foul odor suction of port, and numeral 20 designates a hole through which a pair of nozzles 21*a* and 21*b* enter into and leave out as shown in FIG. 9.

The nozzle 21*a* is used to wash hips and anal portion and the nozzle 21*b* is used for washing the urinary portion of a woman.

Figure 10A:
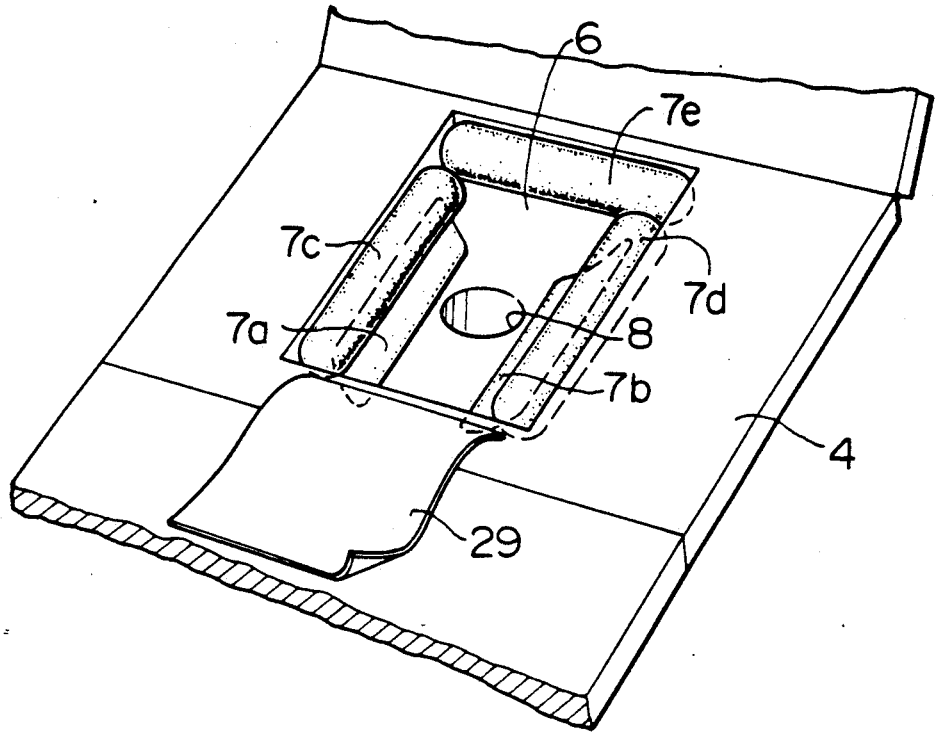
FIGS. 10A to FIG. 10C are perspective views, each showing the way of using the bed according to the present invention, respectively.
Figure 10C:
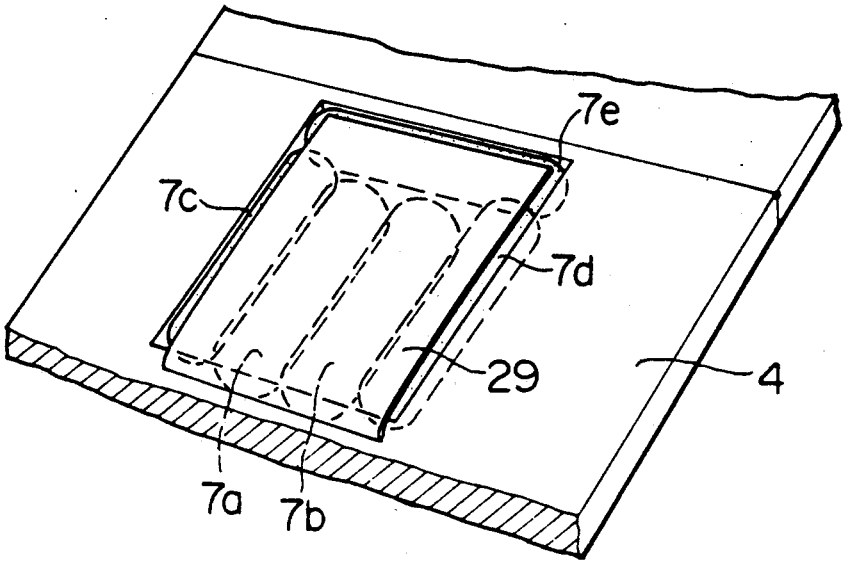
Figure 10B:
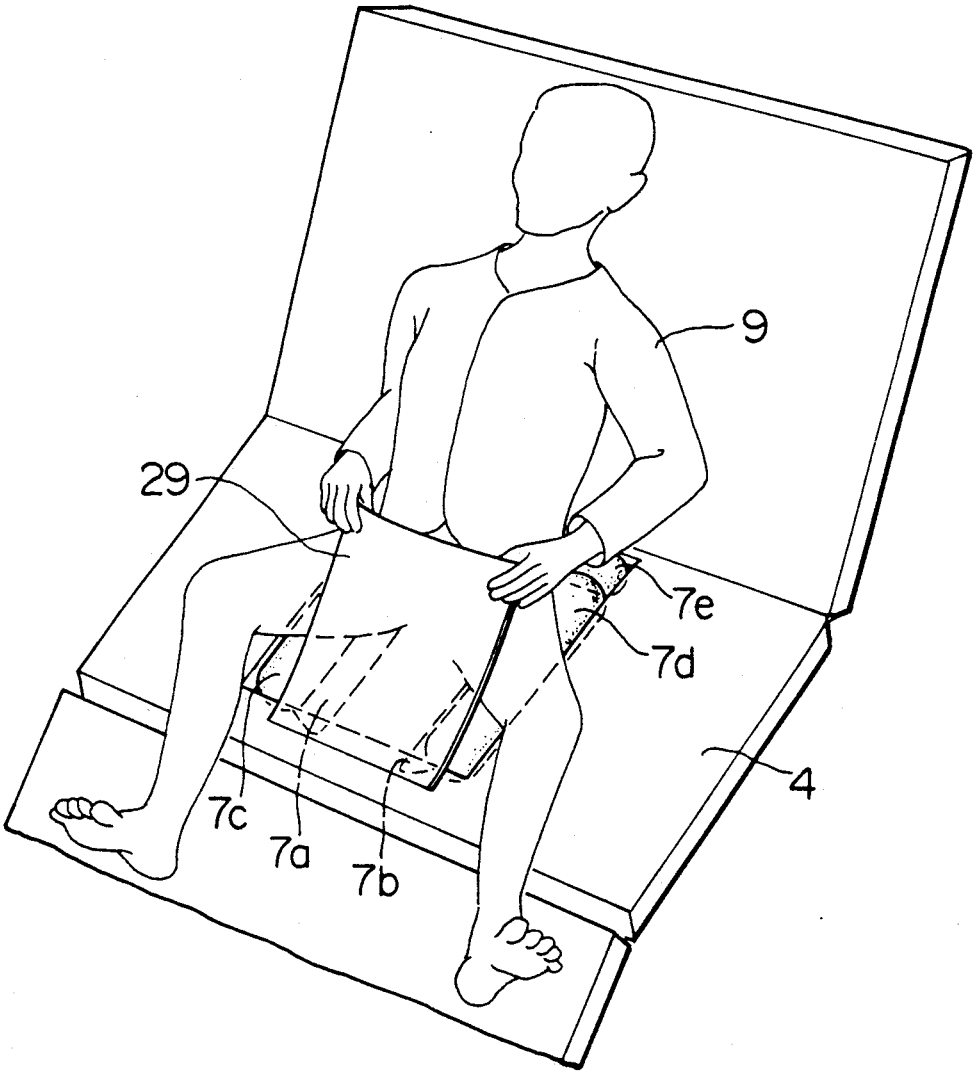

Numeral 22 designates a container for storing washing water used for hip bathing, washing the anal portion 9*b* and the commode 6, numeral 23 designates an operating panel on which various switches 24 are provided to actuate the air compressor 10*a*, vacuum pump 10*b* and the like, numeral 25 designates an odor suction pipe connected to the odor suction port 19, numeral 26 designates a suction pump connected to the odor pipe 25, numeral 27 designates a pipe having a one end thereof connected to the suction pump 26 and the other end connected to a deodorization tank 28, numeral 29 designates a cover sheet which is stretched out as shown in FIG. 10A and covers the anal portion 9*b* and urinary portion of the patient 9 as shown in FIG. 10B upon discharge of the excrement, but it usually covers the pads 7*a* through 7*e* as shown in FIG. 10*c*.

Note that the air used to inflate and deflate the above respective rubber pads 7*a* to 7*e* and the valve 14 may be replaced by other fluids such as oil or the like.

Next, operation of the bed with the built-in commode of this embodiment will be described.

Figure 4:
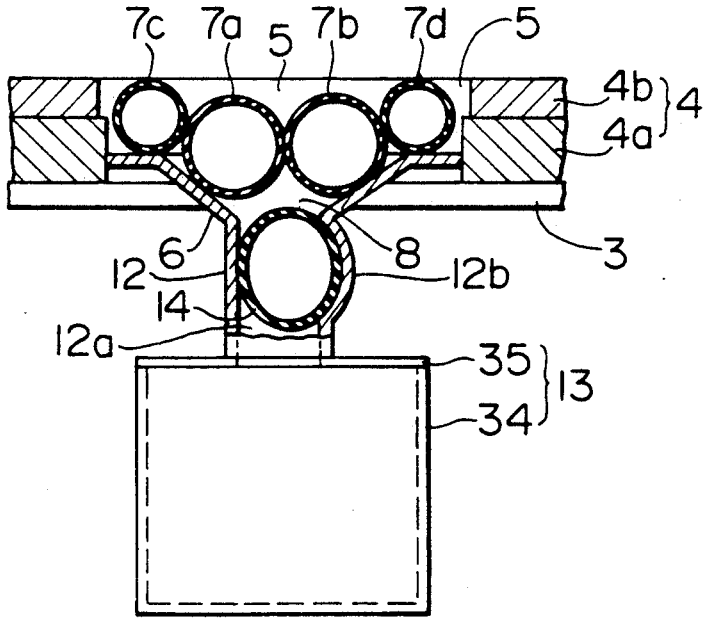
FIGS. 4, 6, 8, 13, 16, and 18 are cross sectional views, each being taken along the line IV—IV, VI—VI, VIII—VIII, XIII—XIII, XVI—XVI, and XVIII—XVIII of FIGS. 3, 5, 7, 12, 15, and 17, respectively.

Firstly, when the bed is used as an ordinary bed, the air compressor 10*a* of the air supply and discharge device 10 is driven to inflate the respective rubber pads 7*a* to 7*e* as shown in FIGS. 3 and 4.

The inner rubber pads 7*a* and 7*b* at the central portion are held in abutment with each other so as to be kept in flat.

In this state, the patient 9 lies flat on the mattress 4 being extended in a flat state.

At the time, the hips 9*a* are supported by all the rubber pads 7*a*, 7*b*, 7*c*, 7*d* and 7*e*.

When the patient 9 wishes excretion he is laid reclining on the head mattress section 4*c* of the mattress 4 being raised up and leaning his legs on the leg mattress section 4*d* being slightly inclined downward.

Figure 5:
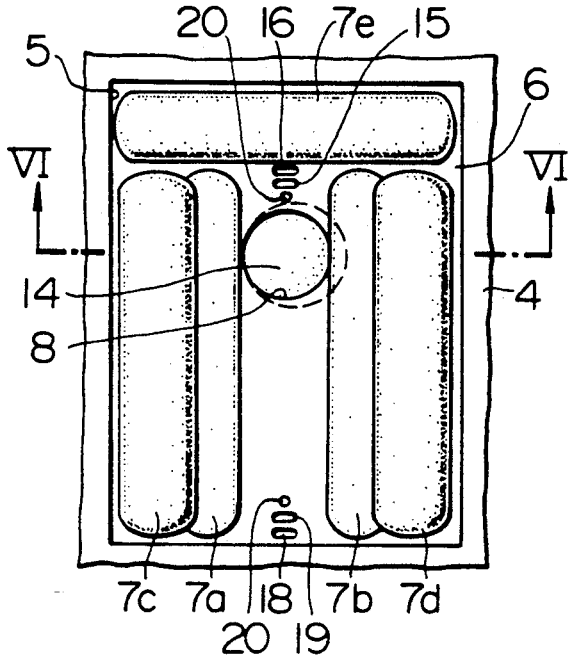
Figure 6:
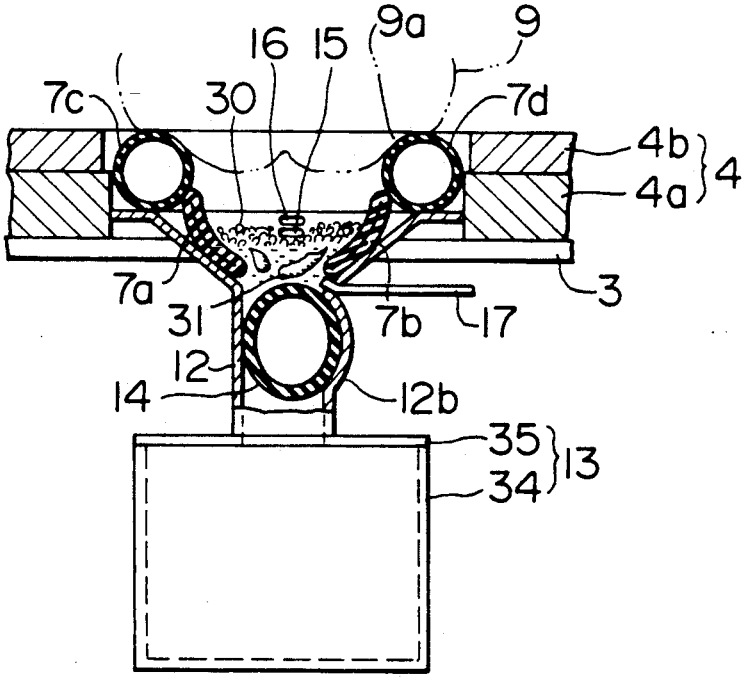
Figure 7:
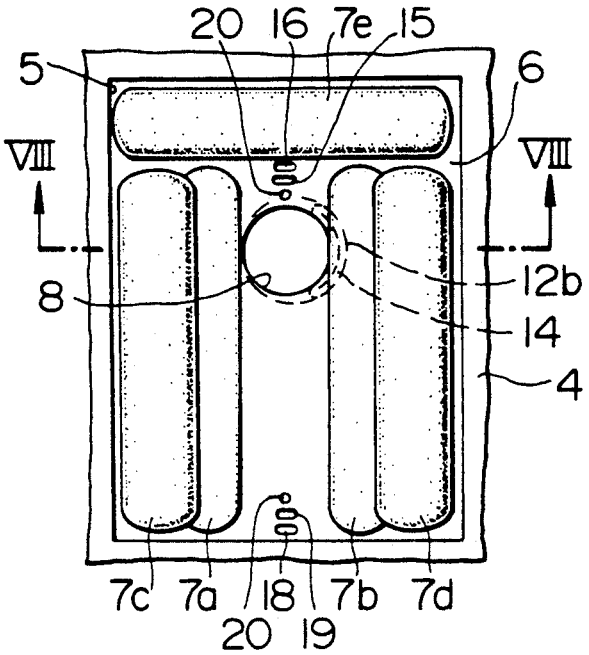

Thereafter, the air suction vacuum pump 10*b* of the air supply and discharge device 10 is driven to forcibly suck the air in the rubber pads 7*a* and 7*b* to deflate them, whereby the commode opening 8 is opened at the central part of the mattress 4 as shown in FIGS. 5 and 6 and the inflated rubber pads 7*c* to 7*e* function as a commode seat.

Then, as shown in FIG. 6, the discharge passage 12*a* is closed by the valve 14, then a predetermined amount of hot water is supplied to the commode 6 from the hot water supply port 15 and is stored therein to form a pool further liquid detergent or aqueous solution of concentrated detergent is added through a water inlet port 16 by a metering pump, and at the same time, air is supplied through the air inlet port 17 at the bottom of the commode 6 to form bubbles 30 in the hot water contained in the commode 6.

In particular, hot water is effective when the bubbles of detergent are utilized, and the excrement is introduced into the hot washing water having bubbles.

Usually, water is satisfactorily used as a material to be stored in the commode 6, but by ulitizing the foaming of detergent, treatment of the excrement can be done with less amount of water, and further, instead of forming the bubbles within the commode 6 as explained above, a mixture of water and detergent may be prepared previously to form bubbles in the other container (not shown) by means of an air pump or the like and the thus formed bubbles are supplied to the commode 6 via the inlet port 16, then the interior of the commode 6 could be filled with large amount of such bubbles, by which offensive odor which otherwise may emit from the excrement 31 in the commode 6 can be securely sealed within the commode 6 and will never float outside and into the room.

Either of oil detergent or synthetic ones can be used satisfactorily, but oil detergent is preferable, since the bubbles formed from the oil detergent are apt to disappear sooner than those from the synthetic ones and are less apt to fill the excrement tank 13.

By virtue of the bubbles as mentioned-above, the remaining water and excrement 31 can be washed away completely into the excrement tank 13 without causing any adhering onto the wall of the commode 6.

Note that offensive odor during the excretion is sucked from the suction port 19 through the odor pipe 25.

Figure 11:
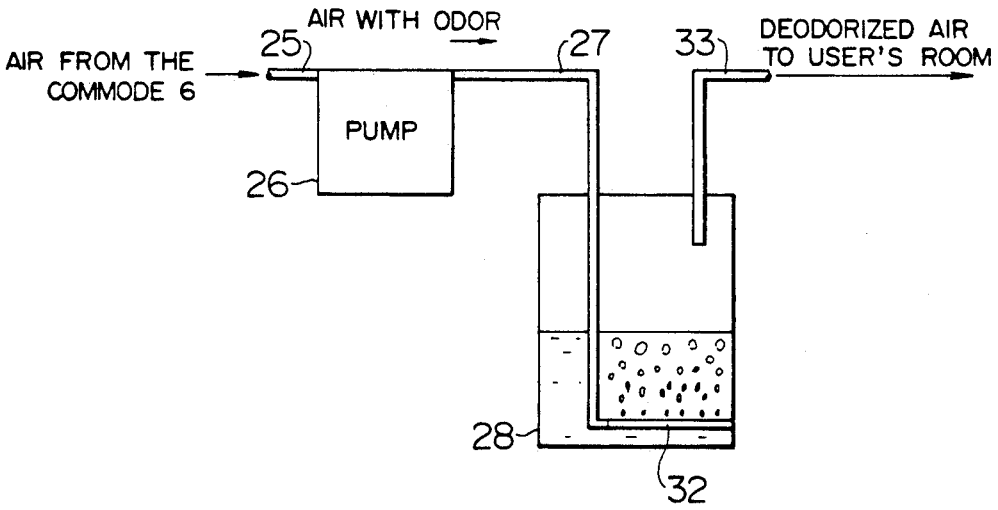
FIG. 11 is a diagram showing an odor discharge and recirculation system.
Figure 12:
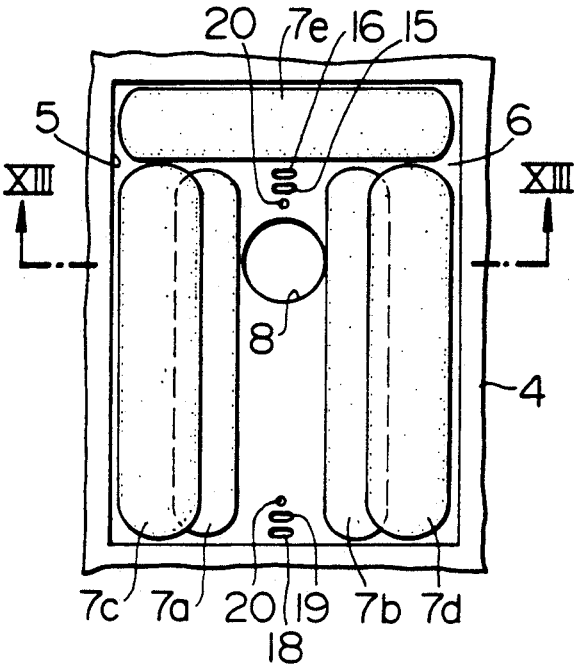

A supplementary explanation will be made hereunder, by referring to FIG. 11, on the odor discharge device.

More specifically, the odor discharge device comprises, the pipe 27 having its one end connected to the one end of the suction pump 26 which is connected to the odor pipe 25 and its the other end connected to a glass or ceramics filter 32 through which a large number of fine pores having a diameter of about 100 micron meters are defined, the deodorization tank 28 in which water or deodorization water solution (e.g., water to which deodorant and the like are added) is stored, and a pipe 33 for circulating the deodorized air into a room or rooms.

Note, though not shown in the drawing, an odor prevention effect will be enhanced by providing a hole from which a perfume of vegetable aromatic agent having an herbal fragrance or the like is introduced after the patient's excretion.

Figure 8:
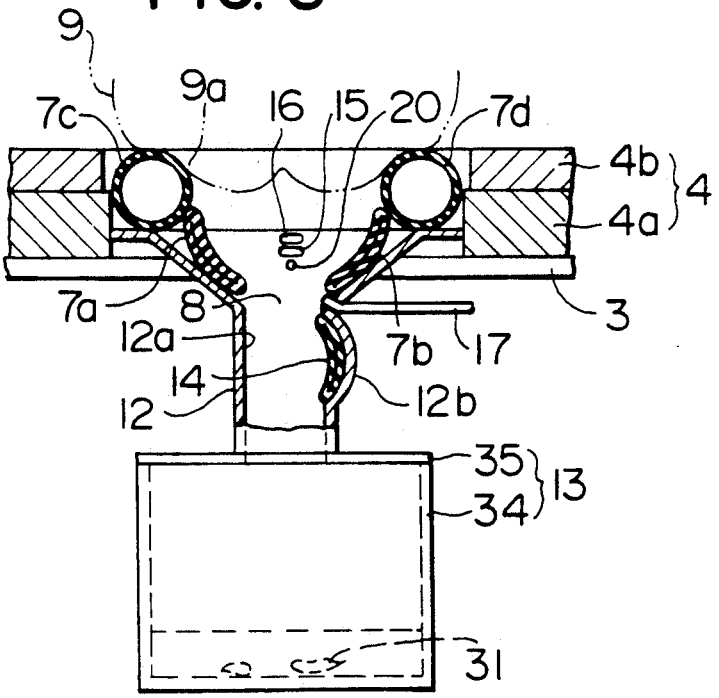

When the patient 9 has finished excretion, the valve 14 is deflated in a flat state as shown in FIG. 8 and received in the recess 12*b* defined in the discharge pipe 12, and thus it becomes difficult for the excreted matter passing through the discharge passage 12*a* to adhere to the valve 14, and thus the excreted matter adhered to the commode 6 and the rubber pads 7*a* and 7*b* are washed away by the washing water supplied through the hot water supply port 15.

By mixing a suitable bactericide to the washing water, colon bacilluses attached to the commode 6 and the rubber pads 7*a*, 7*b* and the like are sterilized and these members can be always kept clean.

At the same time, in order to wash the anal portion of the user after his excretion, the nozzles 21*a* and 21*b* which can be advanced into and retracted away from the commode 6 are extended, as shown in FIG. 9, to spray hot water shower to the hips, anal portion and the private parts of the patient to wash away the excreted matter and urine attached thereto, then hot air is blown to the hips and anal portion and the like from the hot air outlet port 18 to dry them, after the excreted matter has been washed away.

Figure 13:
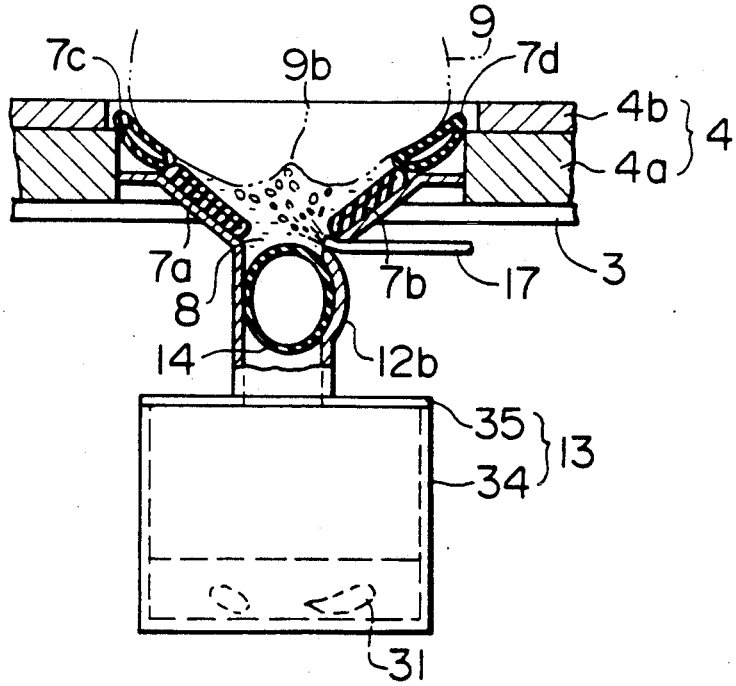

Next, when the discharge passage 12*a* is closed by way of introduing pressurized air to the valve 14, hot washing water is supplied from the hot water supply port 15 so as to be stored in the commode 6, and the air in the rubber pads 7*c* to 7*e* is discharged so that the hips 9*a* and anal portion 9*b* of the patient 9 can be lowered and dipped in the washing water stored in the commode 6, as shown in FIG. 13.

Next, bubbles are formed by hot air blown into the washing water from the air inlet port 17 and the anal portion 9*b* is washed by the washing water and bubbles in the washing water.

In addition, the detergent also has sterilizing effect, therefore, the rubber pads 7*a* and 7*b* being in contact with the bubbles of detergent are less liable to become musty and the skin of the patient's hips 9*b* always can be kept clean by virtue of the contact with the bubbles of the detergent.

Since the air blown into the water for washing the anal portion 9*b* is heated air, the temperature of the hot washing water is difficult to be lowered even in winter when the room temperature is considerably low, and thus the anal portion 9*b* of the patient 9 is comfortably washed by the hot water of a moderate temperature.

After the anal portion 9*b* of the patient 9 has been washed, the air in the valve 14 is discharged to be deflated to open the discharge passage 12*a*, so that the used washing water can be discharged into the excrement tank 13.

When the used washing water is discharged from the commode 6, air is supplied to the rubber pads 7*c* to 7*e* to inflate them and the air is also supplied to the valve 14 to inflate the same.

Then, the anal portion 9*b* of the patient 9 is dried by the hot air blown from the hot air outlet port 18.

Figure 14:
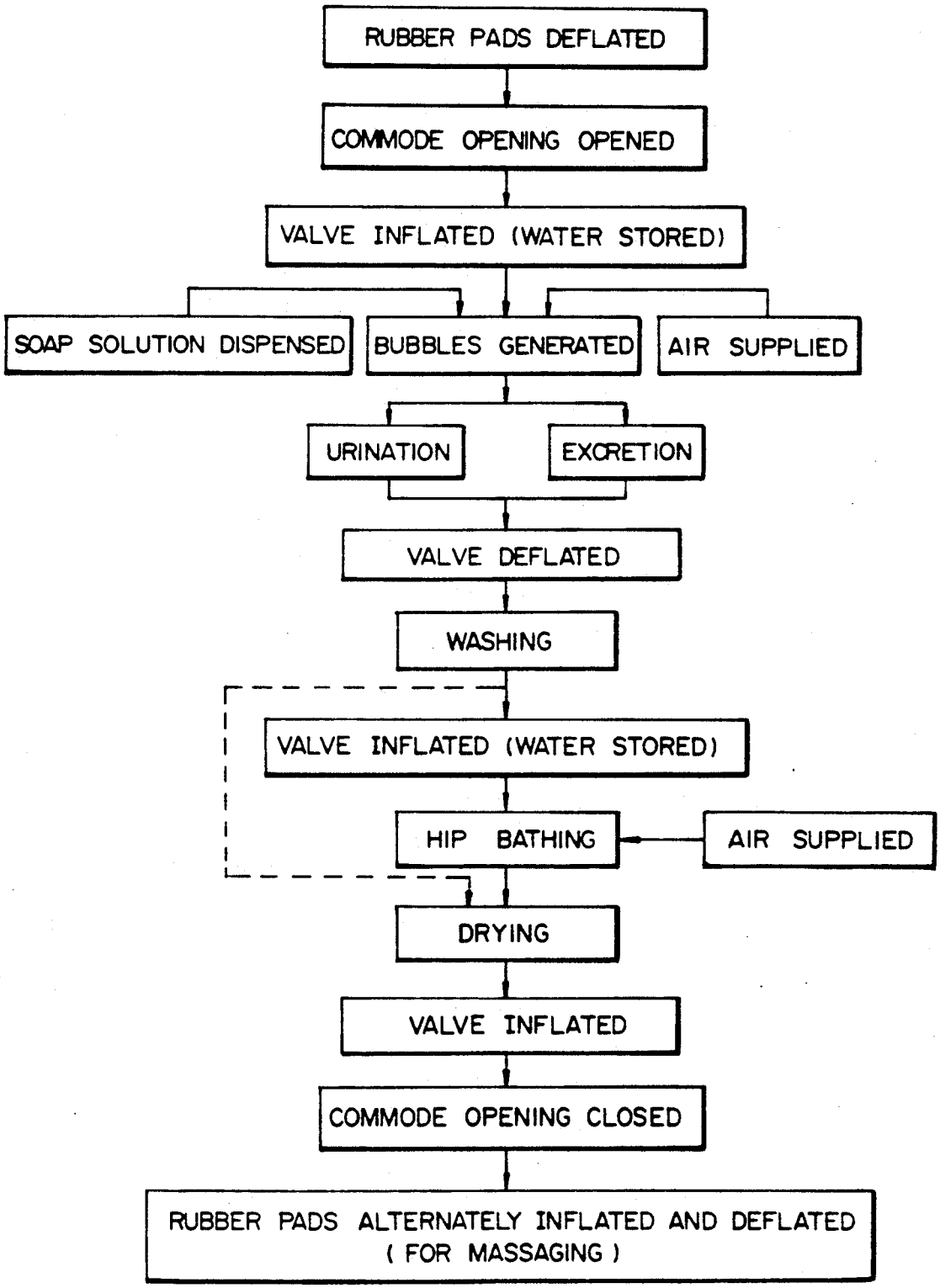
FIG. 14 is a flow chart showing successive steps of using the bed having a built-in commode carried out according to the present invention by manipulating an operating panel.
Figure 15:
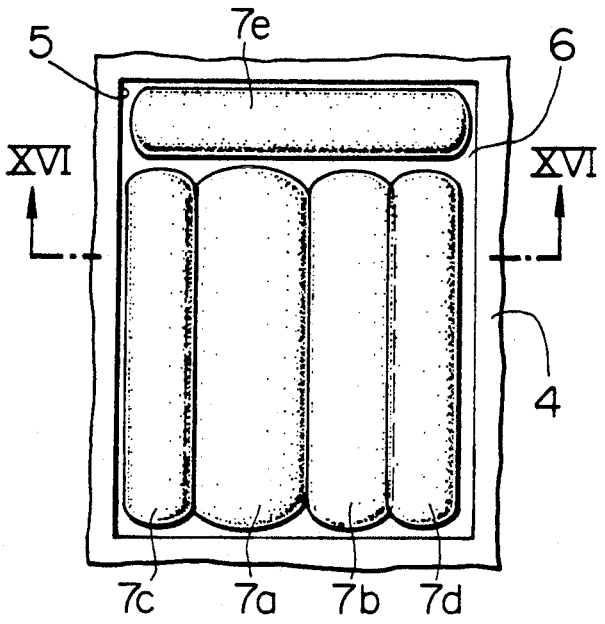
Figure 16:
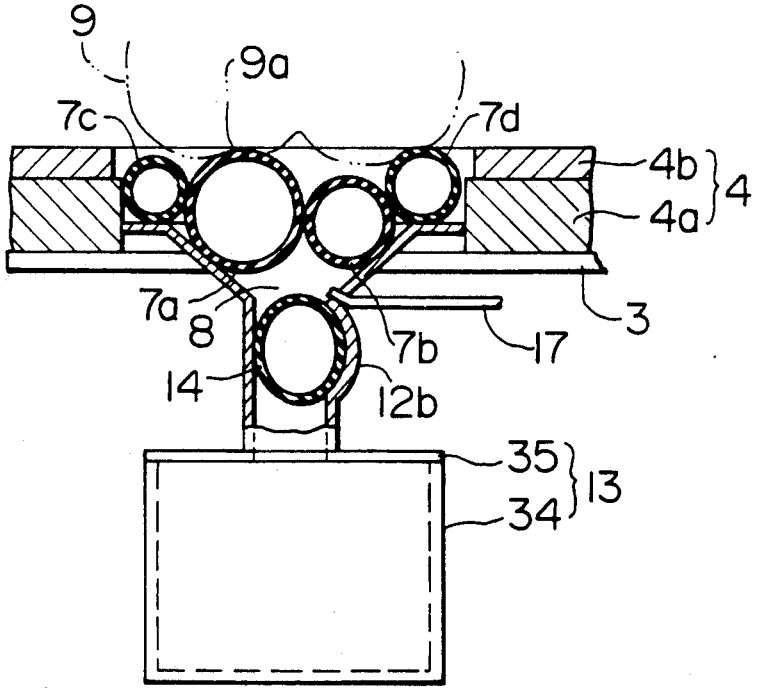
Figure 17:
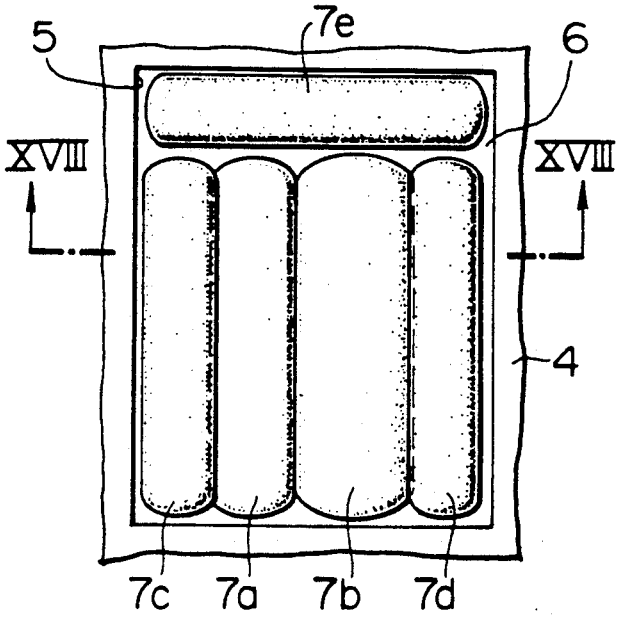
Figure 18:
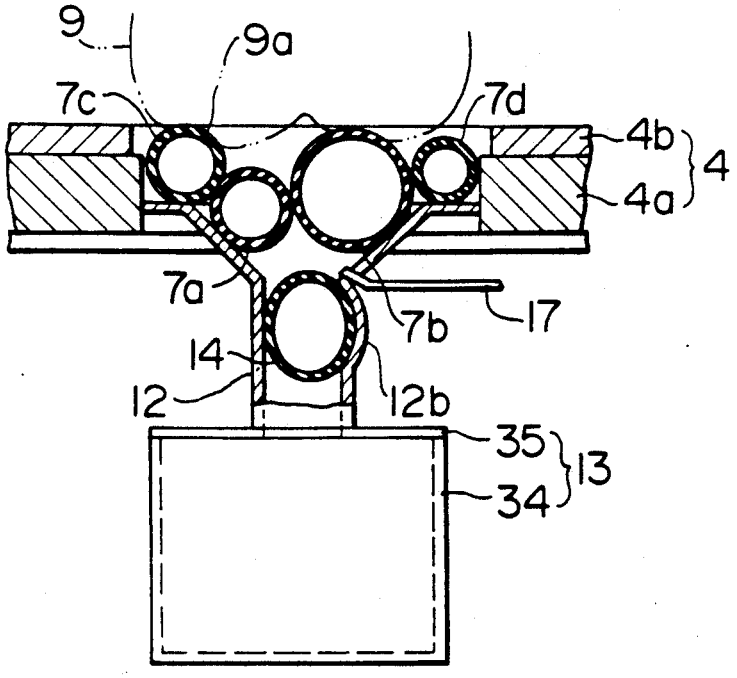

FIG. 14 is a flowchart showing the sequence of the process for inflating and deflating both the respective rubber pads 7*a* to 7*e* and the valve 14 and supplying the washing water, soap solution, air and the like effected by the control through the operating panel 23 of the embodiment of the present invention, and these operations are suitably effected by the control program of an arithmetic operation unit such as a microcomputer or the like incorporated in the operating panel 23.

After the patient 9 has finished excretion, the rubber pads 7*a*, 7*b*, 7*c* and 7*d* are inflated to be brought into abutment together inside the commode 6 by actuating the air compressor 10*a* of the air supply and discharge device 10 to enable the rubber pads 7*a* and 7*b* to have a moderate extent of softness.

In this state, gaps are defined to some extent between the two adjacent rubber pads 7*a* to 7*e* themselves and between the commode 6 to provide them with a suitable gap to effect cushioning even when the pads are highly inflated hard, and this adjustment is made to prevent the patient 9 from having bedsores of the hip or hips 9*a*.

Since, however, the valve 14 is inflated by the air from the air compressor 10*a* to seal the discharge passage 12*a* offensive odors do not exit from the commode opening 8 through the through-hole 5 and float into the room, even if excrement and urine are not discharged immediately after they have been excreted.

It is to be noted that the head mattress section 4*c* of the mattress 4 is brought down flat so that the patient 9 can be returned to his rest position.

When the patient 9 is in the rest position, the rubber pads 7*a*, 7*d* and the rubber pads 7*b*, 7*c* and 7*e* are alternately inflated and deflated by the air from the compressor 10*a* and the vacuum pump 10*b*, as shown in FIGS. 15 to 18 to change the portions of the pads supporting the hips 9*a*, at a cycle, for example, of 20 to 30 minutes, whereby poor blood circulation of the patient can be prevented, and further a massaging effect also can be obtained by making the cycle shorter.

At this time, the foul odor in the excrement tank 13 does not exit to the room from the commode opening 8 through the through-hole 5 by the closing of the valve 14.

Figures 19A, 19B:
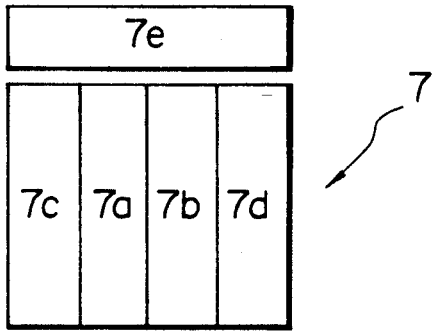
FIGS. 19A and 19B are plan views, each showing the disposition of rubber pads *7a–7e* and a diagram showing a mode of control for applying massaging function to the rubber pads, respectively.
Figure 20B:
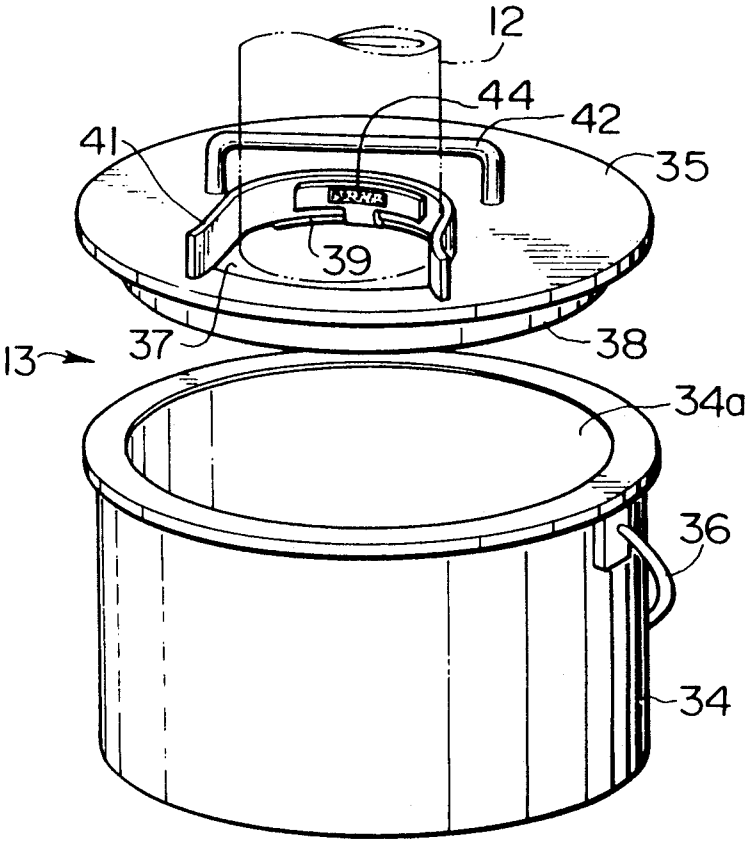
FIGS. 20A and 20B are perspective views, each showing a detachable excrement tank applicable to the bed with a built-in commode according to the present invention.
Figure 20A:
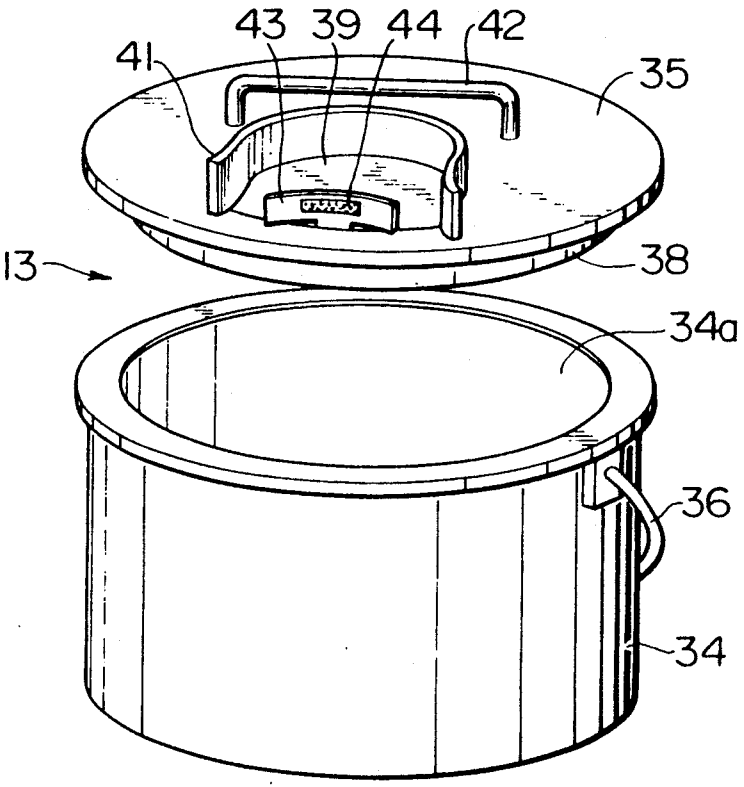

FIGS. 19A and 19B show a manner of control for inflating and deflating the respective rubber pads 7*a* to 7*e* to effect the above-mentioned massaging.

FIG. 19A shows only the relative location of the rubber pads 7*a* to 7*e* taken out for illustration, and FIG. 19B shows a cyclic control applied to these rubber pads 7*a* to 7*e*, wherein the term "hard" shows an interval during which the rubber pads are inflated to be a hard state and the term "soft" shows an interval during which the rubber pads are deflated to a suitable extent of softness.

Note that these controls can be effected by using a microcomputer or the like incorporated in the operating panel 23 and by setting a program necessary for the control.

Next, the construction of the above-mentioned excrement tank will be described in detail with reference to FIGS. 20A, 20B, 21A and 21B, wherein the same numerals are used to show the parts corresponding to the arrangements previously described.

The excrement tank 13 comprises a bucket-shaped container 34 and the lid 35 thereof, and the lid 35 is engaged with the mouth portion 34*a* of the container 34 having a handle 36 attached to the side face thereof.

The lid 35, an opening 37 to be connected to the discharge pipe 12 to accommodate the user's excrement, an annular projection 38 the outer diameter of which is substantially equal to the inner diameter of the container 34 and is provided on the reverse side of the lid 35 to ensure tight connection of the lid 35 with the container 34, and further a small plate-shaped door 39 which is slidably attached to a door holding guide 40 placed at the lower position of the above opening 37, so that said door 39 can be lateraly inserted or pulled out.

Designated by numeral 41 is a guide portion projectingly provided with its open edge at one peripheral side of the opening 37 of the lid 35 and having a curved shape slightly larger than the diameter of the discharge pipe 12, and the portion designated by numeral 42 is a lid handle to enable the lid 35 to be easily mounted and dismounted.

Numeral 43 designates a curved projection provided at the one edge side of the upper portion of the small door 39 and having a fixing member 44 such as a rubber magnet, a magic fastener or the like attached to the curved surface thereof, and a fixing member 45 (FIG. 21B) composed of the same material to be mated with said fixing member 44, is also disposed at the outer circumference of the discharge pipe 12.

Next, operation of the excrement tank will be explained.

Firstly, in order to place the excrement tank 13 below the bed main body 1, an attendant horizontally pushes the excrement tank 13, carried by hand or placed on a cart, toward the opening at the extreme end of the discharge pipe 12 of the bed main body 1.

In this case, the excrement tank 13 is positioned such that the projection 43 having the fixing member 44 and the guide portion 41 disposed on the lid 35 are forwardly positioned to face the attendant.

Figure 21A:
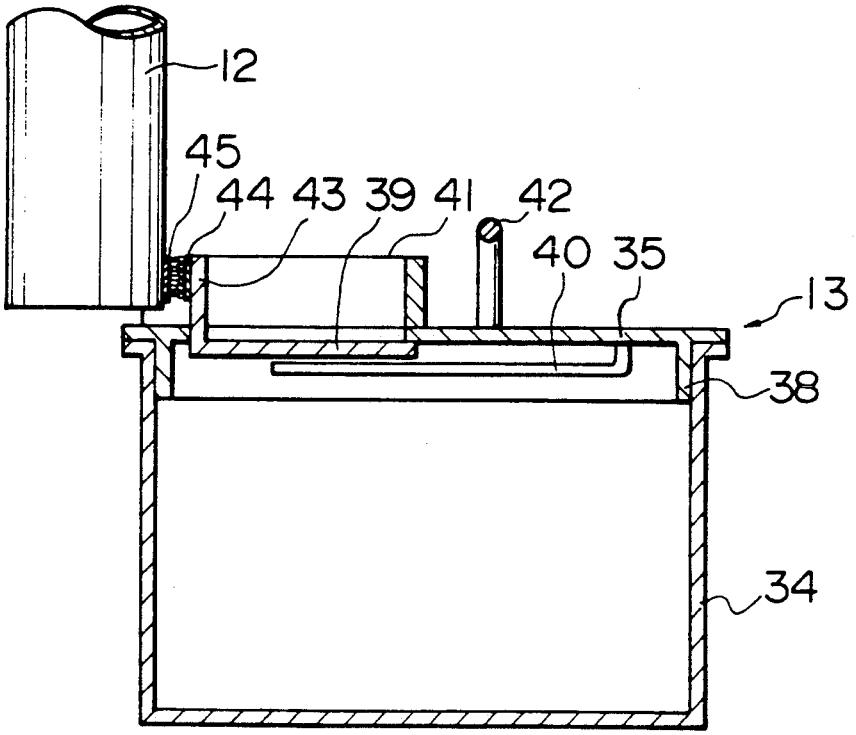
FIGS. 21A and 21B are front views in vertical cross section of the commode.

Attendant's pushing of the excrement tank 13 in this state, the lower end of the discharge pipe 12 of the commode 6 is guided to the opening of the curved guide portion 41 disposed on the lid 35, and the fixing member 44 provided on the lid 35 is connected to the fixing member 45 provided on the outer circumference of the discharge pipe 12, whereby the excrement tank 13 is correctly positioned (refer to FIG. 21A).

Figure 21B:
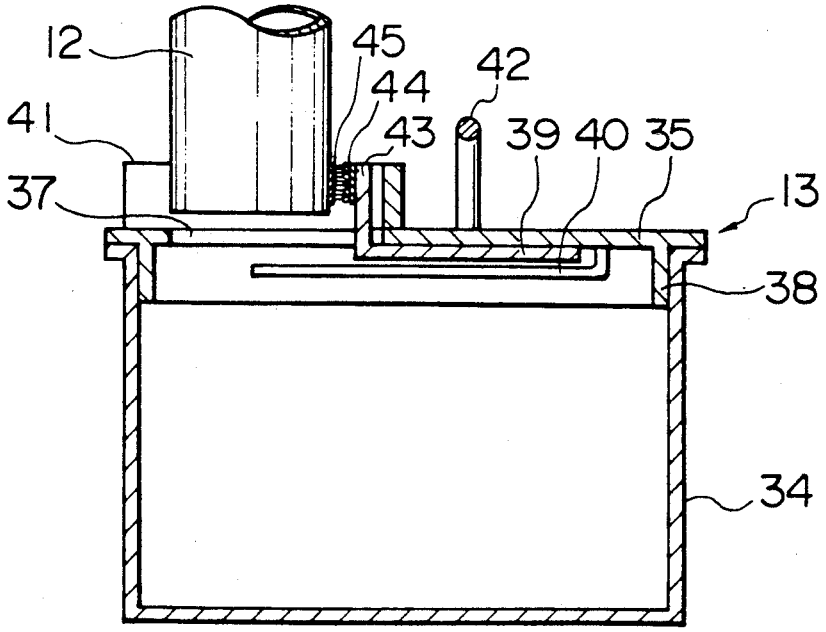

When the excrement tank 13 is pushed further, the door 39 of the lid 35 slidingly retracts along the guide 40 being depressed by the discharge pipe 12 so that the opening 37 of the lid 35 is opened and thus the discharge pipe 12 can be coupled to the opening 37 (refer to FIG. 21B).

When the patient 9 on the bed main body 1 carries out excretion, excrement will fall down from the commode 6 into the container 34 through the discharge pipe 12 and the opening 37 of the door 39.

When the excrement tank 13 is fully filled with such excrement, the excrement tank 13 is pulled out toward this side (in a lateral direction) from the bed main body 1 which is opposite to the above coupling step.

More specifically, if the excrement tank 13 is moved in a direction opposite to that when it was placed, the door 39 is pulled out to the opening 37 on the contrary, so that the opening 37 can be automatically closed, since the fixing member 44 is fixed to the mating fixing member 45 of the discharge pipe 12.

Thereafter, the excrement tank 13 is transported to a dumping area by the attendant either manually holding the handle 36 or by using a cart, and the lid 35 is taken off to dump the excrement.

Then the container 34 is washed, covered again with the lid 35, pushed forward on the floor to the portion just below the bed main body 1, and then set to the lower extreme end of the discharge pipe 12.

The above bed with the built-in commode according to the present invention is explained, for example, as a bed in a private room of a hospital for a bedridden patient and having an individual excrement tank below the bed.

However, in near future, it is expected for large hospitals that there will be a demand for a plurality of these beds with built-in commodes, and in this case, a plurality of such beds may be arranged in a single room for patients of a similar bedridden condition and their excrement would be gathered into a large sized common excrement tank.

Figure 22:
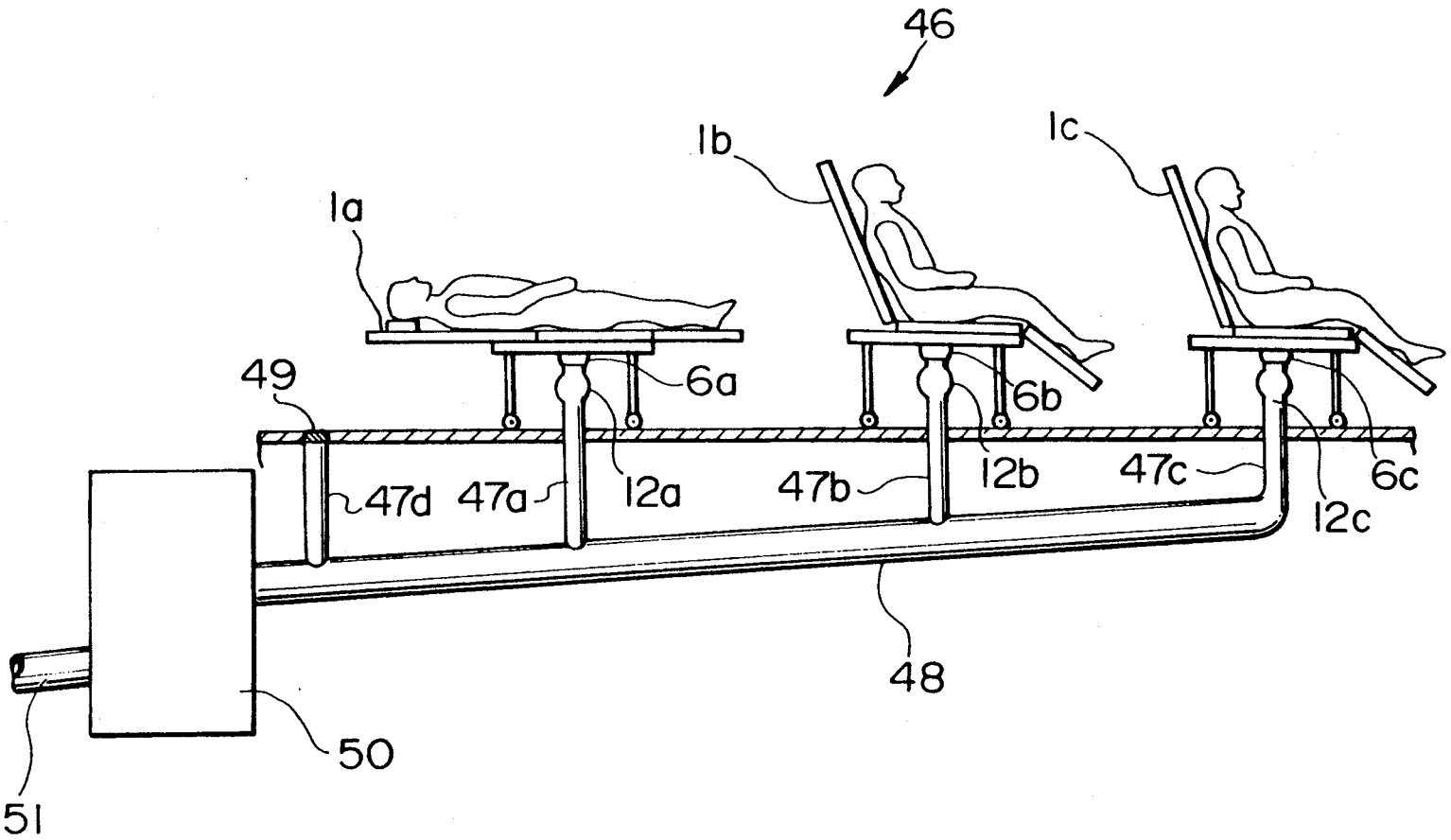
FIG. 22 is a front view showing another embodiment according to the present invention.

FIG. 22 shows another embodiment according to the present invention to satisfy the aforesaid requirement.

In FIG. 22, numerals 1*a* to 1*c* designate bed main bodies in an array of beds each of which having a buit-in commode according to the present invention, numeral 46 designates a sick room of a hospital or an attending room of an old person's home in which these main bed bodies are disposed in an array, numerals 6*a* to 6*c* designate respective commodes, 12*a* to 12*c* designate respective discharge pipes, 47*a* to 47*d* and 48 are sewage pipes connected to the discharge pipes 12*a* to 12*c*, numeral 49 designates a lid covering the discharge pipe 47*d* not being used, and numeral 50 designates a large excrement tank and numeral 51 designates a sewage pipe for dumping.

With this arrangement, the bed with the built-in commode can be effectively used in a sick room in which a large number of patients are accomodated.

According to the present invention, the bed with the built-in commode is constructed by comprising, a plurality of pads disposed in a commode arranged in the through-hole of a mattress and being deflatable to open the opening of the commode, while supports the patient's hips when they are inflated, and a valve diposed in the discharge pipe of the commode and opens or closes the discharge pipe, and thereby having excellent meritorious effects as described below:

When the user wishes to excrete, the opening of the commode is opened by deflating some pads while the patient lies reclining on the erected head mattress.

When the user does not excrete and rests on the bed, parts of the pad may be alternately inflated and deflated so that the user can be relieved from bedsores liable to be caused at his hips.

Since the pad is made flexible even when it is inflated to impart a cushioning property to the portion being in contact with the hips, complete sealing of the commode opening cannot be effected, however, the odor of the excrement in the excrement tank is not discharged and does not float into the room through the commode opening because the discharge pipe is tightly sealed by a valve.

In particular, a plurality of bar shaped rubber pads are alternately inflated and deflated by a predetermined sequence, whereby a massaging effect can be effectively applied to the hips of a patient in rest position.

Further, the valve is composed of a rubber ball and the rubber ball is inflated after excretion to close the discharge passage, whereby the commode is sealed from the excretion tank side to prevent the odor caused after the completion of excretion from being discharged into the room, and thus an uncomfortable feeling arising from the offensive odor can be securely eliminated.

According to the present invention, when excretion is carried out, the discharge pipe is sealed by a valve, then the excrement and urine are excreted into the commode after it has previously been filled with bubbles, and thus any kind of excrement (soft or hard) will never adhere to the commode, so that the commode is not made dirty, in addition, since the foul odor of the excrement in the commode is sealed within the commode, such odor will never escape outside and float into the room.

The hips of a user can be washed by spraying hot water from the nozzle after the user's completion of excretion, and further, when a hip bath process is used, hot air is blown into the hot water for washing the hips of the user, and thus the temperature of the hot washing water is difficult to be lowered and the hip of the user can be comfortably washed by the hot water and the bubbles in the hot water. The user can enjoy the so-called hip-bathing, that is, after the discharge passage has been closed by inflating the valve, hot water is pooled in the commode, and then the user puts his hip portion in the pooled hot water through the opening defined by the deflated four tubular pads. Such a hip bathing is preferably carried out after his hips are washed after the excretion, though it can be carried out whenever he desires to enjoy it, since the hip portion usually becomes cold during the excretion. It is noted that this bathing warms up the hip portion so as to improve the user's blood circulation.

The construction for mounting and dismounting the excrement tank according to the present invention is effected such that the fixing member attached to the side wall of the discharge pipe can be held in abutment with the fixing member of the curved projection provided with the peripheral edge of the door to enable a predetermined setting thereof to be easily carried out, and in case that the excrement tank is filled with excrements, the excrement tank is concurrently covered with the lid as soon as the excrement tank is displaced in a direction opposite to that at the time of setting, together with the disengagement of the mating fixing members and thereby the excrement tank can be easily taken out.

In this case, since the discharge pipe is of a straight shape, it is difficult for the excrement to adhere thereto and it can be kept clean and can be conveniently handled.

What is claimed is:

1. A bed with a built-in commode, comprising:

a bed frame;

a mattress having a through-hole formed at a substantially central portion thereof and placed on said bed frame;

a commode having left and right opposed edge parts and attached to said mattress at said through-hole;

a water inlet port disposed in said commode;

a discharge passage communicated with said commode;

an inflatable valve disposed in said discharge passage;

a pair of outer tubular pads, one of said outer tubular pads being arranged along said left opposed edge part and the other of said outer tubular pads being arranged along said right opposed edge part;

a pair of inner tubular pads arranged between said pair of outer tubular pads;

wherein said bed has a first mode of operation wherein said valve and said pair of outer tubular pads are inflated while said pair of inner tubular pads are deflated to permit excretion by a patient, and wherein said bed has a second mode of operation wherein said pair of outer tubular pads and said pair of inner tubular pads are deflated while said valve is inflated to permit hip bathing of the patient.

2. A bed with a built-in commode as set forth in claim 1, wherein one of said inner tubular pads and one of said outer tubular pads constitute a first pair, and the other one of said inner tubular pads and the other one of said outer tubular pads constitute a second pair, and wherein said first and second pairs of tubular pads are alternately inflated and deflated in a third mode of operation of said bed.

3. A bed with a built-in commode as set forth in claim 1, wherein said valve is formed as a rubber ball.

4. A bed with a built-in commode as set forth in claim 1, wherein a recess is formed in an inner wall of said discharge passage, and wherein said inflatable valve is set in said recess so that said inflatable valve is retracted into said recess when said valve is deflated.

* * * * *